US006708410B2

(12) United States Patent
Okada

(10) Patent No.: US 6,708,410 B2
(45) Date of Patent: Mar. 23, 2004

(54) CUTTER KNIFE FOR LEFT HANDED AND RIGHT HANDED PERSONS

(75) Inventor: Shoji Okada, Sakai (JP)

(73) Assignee: Olfa Corporation, Osaka (JP)

( * ) Notice: Subject to any disclaimer, the term of this patent is extended or adjusted under 35 U.S.C. 154(b) by 0 days.

(21) Appl. No.: 10/419,794

(22) Filed: Apr. 22, 2003

(65) Prior Publication Data

US 2003/0200661 A1 Oct. 30, 2003

(30) Foreign Application Priority Data

Apr. 25, 2002 (JP) ..... 2002-124296

(51) Int. Cl.[7] ..... B26B 1/08
(52) U.S. Cl. ..... 30/162; 30/320; 30/335
(58) Field of Search ..... 30/335, 336, 320, 30/151, 329, 337, 339, 162, 331, 333, 125, 165

(56) References Cited

U.S. PATENT DOCUMENTS 4,089,112 A * 5/1978 Richards ..... 30/162
4,170,062 A * 10/1979 Machida ..... 30/162
4,240,202 A * 12/1980 Gilbert ..... 30/162
4,292,738 A * 10/1981 Osada ..... 30/162
5,269,063 A * 12/1993 Okada ..... 30/162
D398,829 S * 9/1998 Okada ..... D8/99
6,006,433 A * 12/1999 Baltazar ..... 30/162
6,314,646 B1 * 11/2001 Schmidt ..... 30/162

FOREIGN PATENT DOCUMENTS

JP 59-20872 6/1984

* cited by examiner

*Primary Examiner*—Allan N. Shoap
*Assistant Examiner*—Ghassem Alie
(74) *Attorney, Agent, or Firm*—Crowell & Moring LLP

(57) ABSTRACT

A cutter knife in which a blade connected to a slider is slidably held in an elongated sleeve member. The slider is provided with a first engagement protrusion and a second engagement protrusion located on a forward end and a backward end in the sliding direction of the slider, one of which is to be inserted into a connection hole of the blade for connecting the slider and the blade. The distance from each of the first and the second engagement protrusions to the inner surface of the sleeve member when the slider is inserted into the sleeve member is smaller than the distance between the connection hole and the back of the blade. This results in biasing the blade back against the inner surface of the sleeve member for protecting the blade edge. When the inserting direction of the slider is reversed, the biasing direction of the blade is also reversed.

3 Claims, 5 Drawing Sheets

CUTTER KNIFE FOR LEFT HANDED AND RIGHT HANDED PERSONS

BACKGROUND OF THE INVENTION

The present invention relates to a cutter knife in which the blade is slidably retracted into an elongated sleeve member. In particular, the present invention relates to a cutter knife wherein a space is kept between the blade edge and an inner wall of the sleeve member, in order to prevent the blade edge from being damaged by rubbing against the inner wall of the sleeve member, while sliding.

FIGS. 1 to 3B show a cutter knife, which is disclosed in Japanese examined utility model publication No. 59-20872. A blade 1 and a slider 10 are connected in an elongated sleeve member 20. A user can manipulate the slider 10 to cause the blade 1 to slide, so that the blade 1 is protruded from and retracted into the sleeve member 20. The sleeve member 20 is provided with a pair of side walls 20*a* and 20*b*, which extend in parallel to the sliding direction of the blade 1. Being guided between the side walls 20*a* and 20*b*, the blade 1 and the slider 10 slide in the longitudinal direction of the cutter knife.

As shown in FIG. 2, a spring member 11 is provided on one side of the slider 10. Under the biasing force by the spring member 11, the blade back 1*b* is pressed onto the inner surface of the side wall 20*a* (the side wall at the upper location in FIG. 1). As a result, a space is kept between the blade edge 1*a* and the inner surface of the side wall 20*b* (the side wall at the lower location in FIG. 1). Thanks to that space, the blade edge 1*a* can be prevented from rubbing against the inner surface of the side wall 20*b*, and thus the blade edge 1*a* can be protected from damage.

The slider 10 is provided with two engagement protrusions 15, 16, which are located at the forward end and at the rearward end of the slider 10 in the sliding direction. One of the engagement protrusions is inserted into a connection hole 2 of the blade 1, so that the slider 10 and the blade 1 are connected. As shown inside the dash-lined frame in FIG. 1, when the inserting direction of the slider 10 into the sleeve member 20 is reversed, the engagement protrusion 16 is now engaged with the connection hole 2, rather than the engagement protrusion 15. As a result, the direction of the biasing force applied to the blade 1 by the spring member 11 is also reversed. In other words; when the inserting direction of the slider 10 is reversed, and further the blade 1 is turned so that the edge 1*a* faces upward as shown in FIG. 1, the blade back 1*b* is pressed onto the inner surface of the side wall 20*b* under the biasing force of the spring member 11, As a result, a space is kept between the blade edge 1*a* and the inner surface of the side wall 20*a*.

The reason why the biasing direction of the blade is reversed is for accommodating the cutter knife to both right handed users and left handed users. This is explained with reference to FIGS. 3A and 3B, which are partially broken end elevations seen from the user side who is grasping the cutter knife.

FIG. 3A shows a situation where a left handed user uses the cutter knife, which corresponds to the case where the slider 10 shown inside the dash-lined frame in FIG. 1 and the blade 1 connected thereto are inserted into the sleeve member 20. In FIG. 3A, the blade edge 1*a* faces downwards. The user grasps the cutter knife in his left hand, and manipulates the slider knob 18 attached to the slider 10 with his left thumb for protruding and retracting the blade 1. The blade 1 is connected with the slider 10 at the engagement protrusion 16, and the engagement protrusion 15 in disengagement can be seen from the user side. The slider knob 18 is in threaded engagement with a threaded hole 17 provided on the slider.

FIG. 3B shows a situation where a right handed user uses the cutter knife, which corresponds to the case where the slider 10 and the blade 1 connected thereto are inserted into the sleeve member 20 as shown by the solid-lined arrow in FIG. 1. Also in FIG. 3B, the blade edge 1*a* faces downwards. The user grasps the cutter knife in his right hand, and manipulates the slider knob 1*a* attached to the slider 10 with his right thumb for protruding and retracting the blade 1. The blade 1 is connected with the slider 10 at the engagement protrusion 15, and the engagement protrusion 16 in disengagement can be seen from the user side.

In the conventional cutter knife as explained above, with reversing the inserting direction of the slider, right handed users and left handed users can properly use it. However, the construction of the slider is inconveniently complicated. Specifically, in order to provide the spring member 11 constructed an shown in FIG. 2 on the slider 10, it is necessary to attach a separate member of a leaf spring on the slider 10, Alternatively, even if a spring portion is integrally formed into the slider 10, a very complicated mold would be necessary, which would increase the cost.

SUMMARY OF THE INVENTION

In view of the above-mentioned circumstance, an object of the present invention is to provide a cutter knife, which has simpler construction and can be properly used by both right handed users and left handed users.

According to the present invention, there is provided a cutter knife, comprising: an elongated sleeve member, a blade slidably held in the sleeve member, and a slider which is connected with the blade and is slidable in the sleeve member in the longitudinal direction, via which the blade is manipulated to protrude from and retracted into the sleeve member. The slider is provided with a first engagement protrusion and a second engagement protrusion located on the forward end and the rearward end in the sliding direction of the slider, one of which is to be inserted into a connection hole of the blade for connecting the slider and the blade. The distance from each of the first engagement protrusion and the second engagement protrusion to an inner surface of one of the sidewalls of the sleeve member when the slider is inserted into the sleeve member is smaller than the distance between the connection hole and the back of the blade. The back of the blade is thereby biased against the inner surface of the sleeve member to keep a space between the edge of the blade and the inner surface of the other sidewall of the sleeve member while the blade is sliding. The first engagement protrusion and the second engagement protrusion are aligned parallel to the sliding direction of the slider. Thus, when the inserting direction of the slider into the sleeve member is reversed, the biasing direction of the blade is also reversed, In the cutter knife constructed as above, when the facing direction of the blade and inserting direction of the slider are reversed, the biasing direction of the blade against the inner surface of the sleeve member is reversed. This advantage itself can be achieved also in the above-mentioned conventional cutter knife. However, in the present invention, the biasing force is attributed to the location (or arrangement) of the engagement protrusions provided on the slider. Thus, any separate members (such as a spring member 11) for providing the biasing force are not necessary, and thanks to this, the construction of the slider can be more simplified than in the conventional cutter knife. Accordingly, the cutter knife can be easily manufactured, leading to a lower manufacturing cost and a lower selling price.

BRIEF DESCRIPTION OF THE DRAWINGS

Thin and other objects and features of the present invention will become apparent from the following description taken in conjunction with the preferred embodiments thereof with reference to the accompanying drawings.

DETAILED DESCRIPTION OF THE PREFERRED EMBODIMENT

Figure 4:
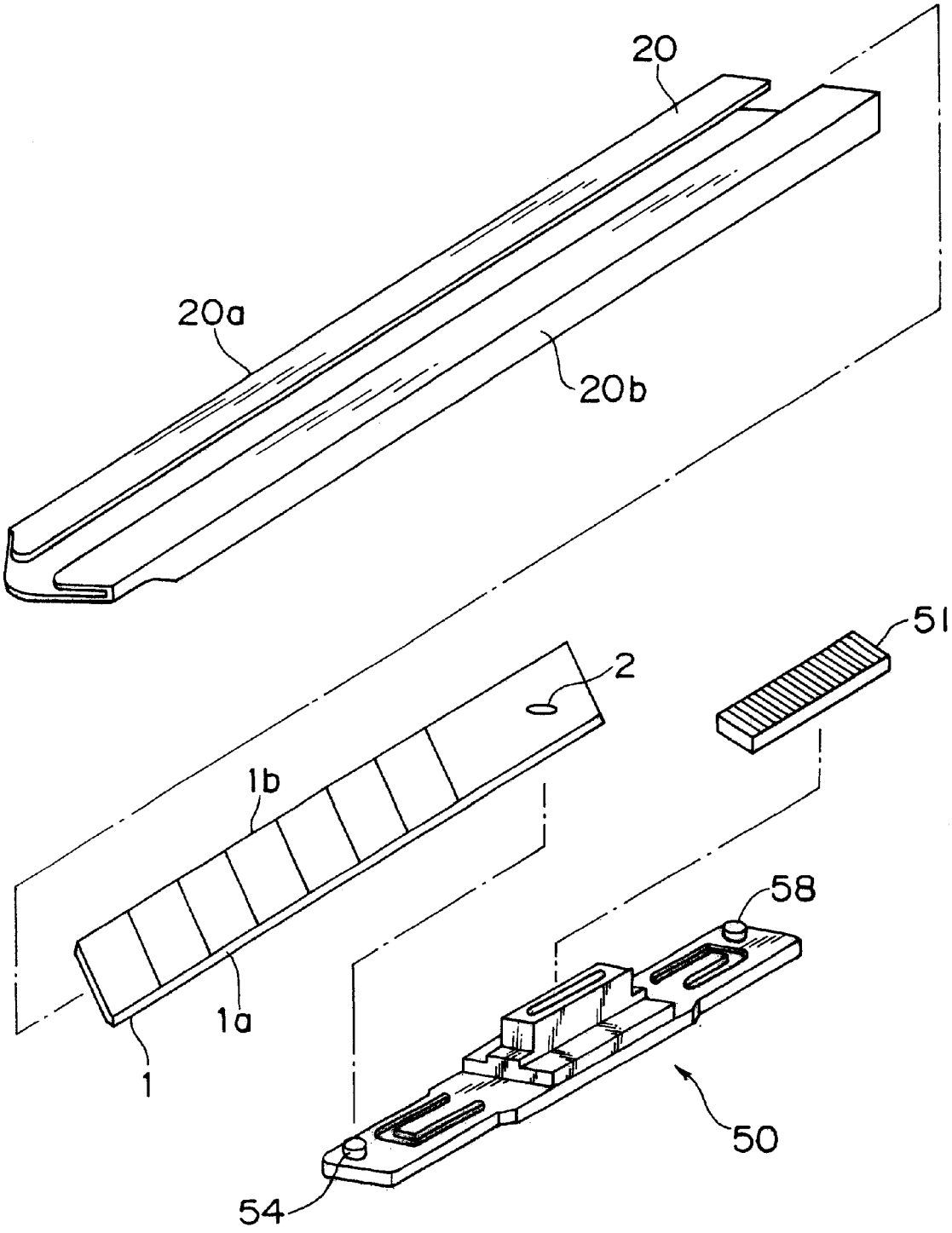
FIG. 4 is an exploded perspective view of a cutter knife according to an embodiment of the present invention.

With reference to FIGS. 4 to 6B, a description is made below on a cutter knife according to an embodiment of the present invention. FIG. 4 shows an exploded perspective view of the cutter knife.

A slider 50 is slidably inserted into a sleeve member 20, and is provided with a first engagement protrusion 54 and a second engagement protrusion 58, which are located on the forward end and the rearward end of the slider in the sliding direction. In FIG. 4, the first engagement protrusion 54 is to be inserted into a connection hole 2 of the blade 1. When the inserting direction of the slider 50 is reversed, the second engagement protrusion 58 is to be inserted into the connection hole 2 of the blade 1. Note that, in such a case, the blade 50 is reversed so that the edge 1*a* of the blade 50 faces in the opposite direction.

A separate member 51, which is to be attached to the slider, is employed as a grip face of the slider 50. However, alternatively a slider integrally including a grip face would be molded. In practice, a user fits his finger on the grip face to manipulate the blade 50.

Figure 1:
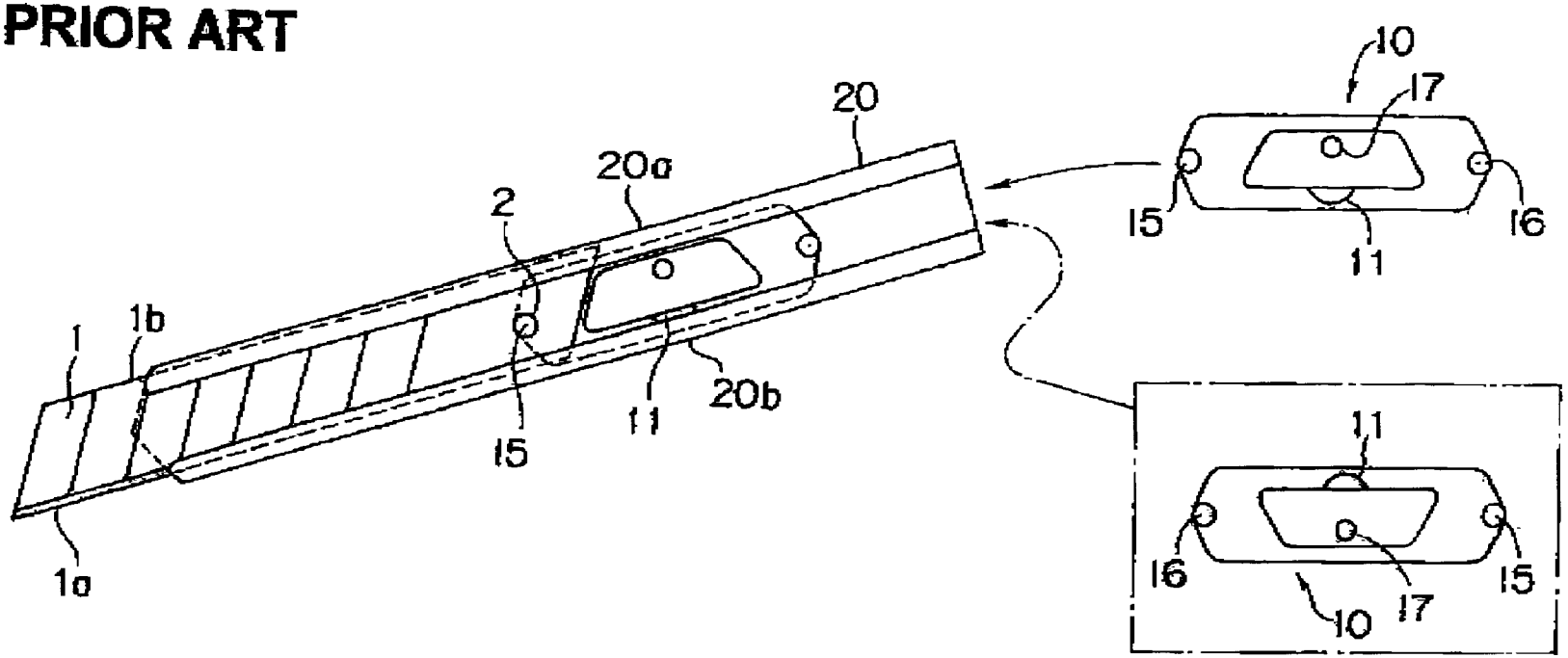
Fig. 1 PRIOR ART
FIG. 1 is an explanatory view showing a conventional cutter knife.
Figure 2:
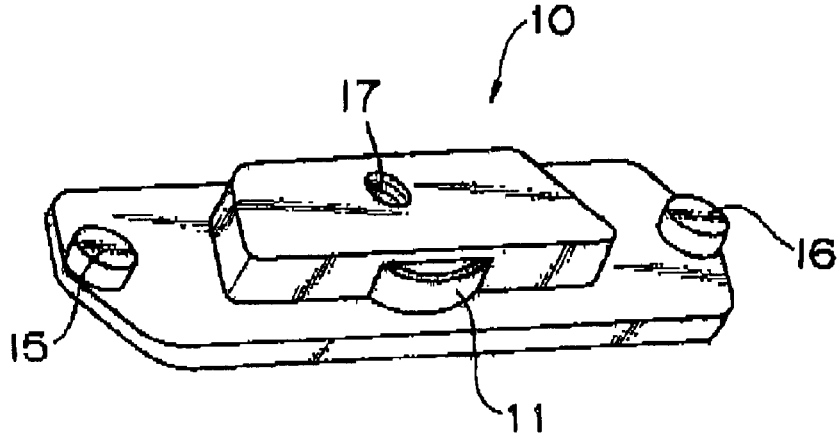
Fig.2 PRIOR ART
FIG. 2 is a perspective view of a slider which is employed in the cutter knife in FIG. 1.
Figure 3A:
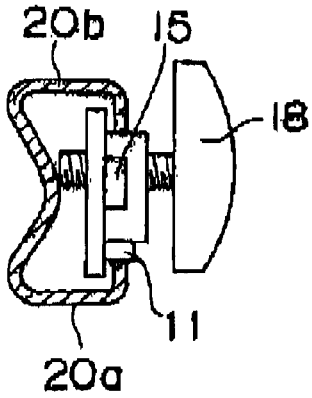
FIG. 3A is an explanatory view showing a condition that the cutter knife in FIG. 1 is used by a left handed user.
Figure 3B:
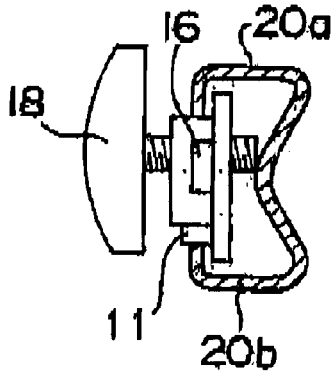
FIG. 3B is an explanatory view showing a condition that the cutter knife in FIG. 1 is used by a right handed user.

Note that in the drawings a lock mechanism for the blade position is omitted, because the present invention is directed to a mechanism for biasing the blade. However, in an actual product, some lock mechanism may be provided for locking the blade in a position in practical use. A lock mechanism can be a screw-type knob 18 as shown in FIGS. 1 to 3. Further, the lock mechanism can be what utilizes an elastic engagement between a spring member on the slider and recesses on the body of the cutter knife (not shown). Note that, the advantage of the simplicity of the slider construction brought by the present invention is directed only to a mechanism, by which the blade back is biased against the inner surface of the sleeve member.

Figure 5:
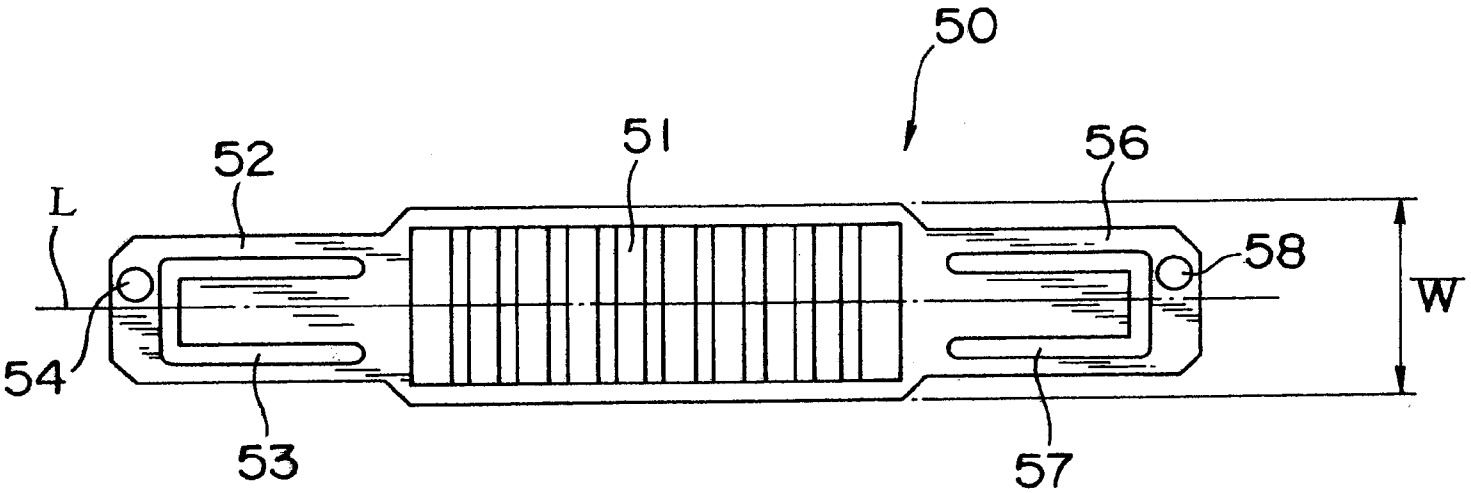
FIG. 5 is a plan view of a slider which is employed in the cutter knife in FIG. 4.

FIG. 5 is a plan view of the slider 50, which explains the construction of the slider 50. In order to realize a smooth sliding of the slider 50 in the sleeve member 20, the maximum width "W" of the slider 50 is sized nearly equal to the distance between the opposing side walls 20*a* and 20*b* of the sleeve member 20. The first engagement protrusion 54 and the second engagement protrusion 58 are offset in the same direction (upper side in FIG. 5) with respect to the center-line "L" shown in FIG. 5. The first engagement protrusion 54 and the second engagement protrusion 58 are aligned parallel with the center-line "L" (that is, parallel with the sliding direction of the slider).

The first engagement protrusion 54 is located on a first extending portion 52, which projects from the grip face 51 in one direction. On the other hand, the second engagement protrusion 58 is located on a second extending portion 56, which projects from the grip face 51, oppositely to the first extending portion 52.

A U-shaped opening 53 and a U-shaped opening 57 are formed on the first extending portion 52 and the second extending portion 56, respectively, so that the configuration of the first extending portion 52 and the second extending portion 56 are frame-like. Thanks to that configuration, both of the extending portions 52 and 56 can be resiliently deformed, and this deformation allows the blade to be biased against the inner surface of the sleeve member, as explained below. Note that the configuration of the slider is not limited to any specific one in the present invention, as long as the distance from each of the first and second engagement protrusions 54, 58 to the inner surface of the side wall when the slider 50 is inserted into the sleeve member 20 is set smaller than the distance between the connection hole 2 and the blade back 1*a* whereby the blade can be resiliently biased against the inner surface of the sleeve member.

Figure 6A:
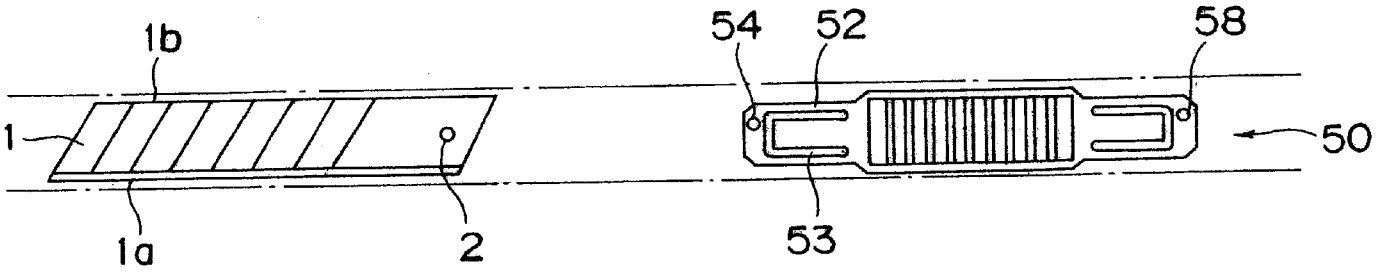
FIGS. 6A and 6B are respectively an explanatory view explaining the relationship between engagement protrusions and biasing direction.
Figure 6B:
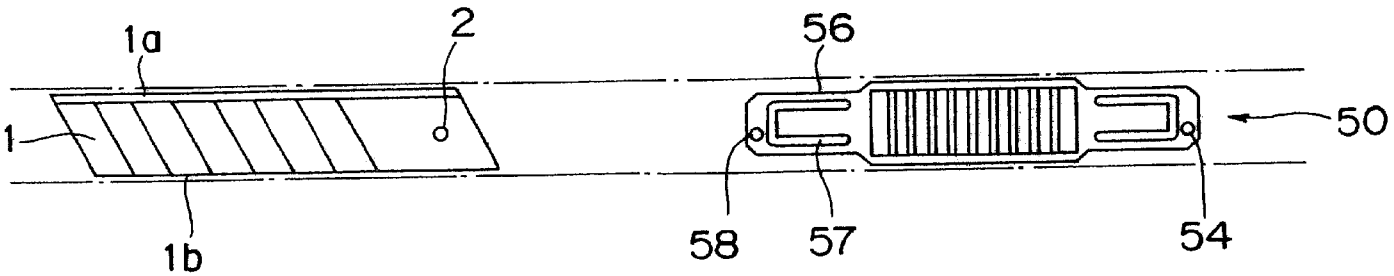

The advantage due to the above-mentioned arrangement of the first and the second engagement protrusions 54, 58 is explained below, with reference to FIGS. 6A and 6B. In FIGS. 6A and 6B, the dashed lines running on both sides of the blade 1 and the slider 50 almost correspond to the distance between the opposing side walls 20*a* and 20*b* of the sleeve member 20 (refer to FIG. 4). That is, the blade 1 and the slider 50 slide in the longitudinal direction, with making their center-line correspond to intermediary between the side walls 20*a* and 20*b*.

As explained above, the first and the second engagement protrusions 54, 58 are offset from the center line "L". Thus, in order to insert the blade 1 and the slider 50 after assembly into the sleeve member 20, it is necessary to deform the first and the second extending portions 52, 56 on which the first and the second engagement protrusions 54, 58 are provided, so that the first and the second engagement protrusions 54, 58 are aligned to the center line "L". Thanks to this, a biasing force is generated, which urges the blade back 1*b* onto the inner surface of the sleeve member. As a result, a space is kept between the blade edge 1*a* and the inner surface of the sleeve member, so that the blade edge 1*a* can be protected.

The first engagement protrusion 54 and the second engagement protrusion 58 are aligned parallel to the sliding direction of the slider 50. Accordingly, when the inserting direction of the slider 50 into the sleeve member 20 is reversed, the direction of the biasing is also reversed. Since the blade 50 is turned around its longitudinal axis so that the blade edge 1*a* faces oppositely when the inserting direction of the slider 50 is reversed, the blade back is always pressed onto the inner surface of the sleeve member.

In the embodiment shown, since the blade is provided with the connection hole 2 at the center of its width, the two engagement protrusions 54, 58 are offset in the same direction from the center line "L". That is, under this construction, the distance from each of the first engagement protrusion and the second engagement protrusion to the inner surface of the side wall when the slider is inserted into the sleeve member is made smaller than the distance between the connection hole and the back of the blade".

Even in a cutter knife of which the connection hole is not located at the center of width, the same effect would be realized by satisfying the relationship of the above two distances. Thus, the present invention can be applied to any blades, which have the connection hole located at any position in its width direction. The degree of the biasing force can be adjusted by the difference between the above two directions.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A cutter knife, comprising:

an elongated sleeve member having a back wall and two opposing sidewalls;

a blade slidably held in the sleeve member; and a slider which is connected with the blade and is slidable in the sleeve member in a longitudinal direction, via which the blade is manipulated to protrude from and retracted into the sleeve member;

wherein the slider comprises a first engagement protrusion and a second engagement protrusion located on a forward end and a backward end, respectively, in a sliding direction of the slider, one of said protrusions is to be inserted into a connection hole of the blade for connecting the slider and the blade, a distance from each of the first engagement protrusion and the second engagement protrusion to an inner surface of one of said sidewalls of the sleeve member when the slider is inserted into the sleeve member being smaller than a distance between the connection hole and a back of the blade, to thereby bias the back of the blade against the inner surface of the sleeve member, so that a space is kept between an edge of the blade and an inner surface of the other of said sidewalls of the sleeve member while the blade is sliding, and the first engagement protrusion and the second engagement protrusion are aligned parallel with the sliding direction of the slider, whereby when the direction of insertion of the slider into the sleeve member is reversed, the direction of biasing of the blade is also reversed.

2. The cutter knife of claim 1, wherein the slider is provided with a grip surface, at its center in the sliding direction, on which a user's finger is to be pressed, and the first engagement protrusion and the second engagement protrusion are located on a first extending portion and a second extending portion, respectively, which extend outwards in opposite directions from the grip surface.

3. The cutter knife of claim 2, wherein the first extending portion and the second extending portion are of frame-like configuration, by which an elasticity for biasing is realized.

* * * * *